US007413478B2

(12) United States Patent
Kleinschmidt et al.

(10) Patent No.: US 7,413,478 B2
(45) Date of Patent: Aug. 19, 2008

(54) ELECTRIC CONTACT FOR CONTACTING A PROTECTING CONDUCTOR WITH CONDUCTIVE HOUSING

(75) Inventors: Stephan Kleinschmidt, Luebbecke (DE); Marco Tadje, Bad Nenndorf (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/677,356

(22) Filed: Feb. 21, 2007

(65) Prior Publication Data

US 2007/0207679 A1 Sep. 6, 2007

(30) Foreign Application Priority Data

Mar. 1, 2006 (DE) ..... 20 2006 003 204 U

(51) Int. Cl.
*H01R 13/502* (2006.01)

(52) U.S. Cl. ..... 439/686; 439/695; 439/737; 439/738

(58) Field of Classification Search ..... 439/680, 439/695, 738, 686, 735
See application file for complete search history.

(56) References Cited

U.S. PATENT DOCUMENTS

| | | | | |
|---|---|---|---|---|
| 4,820,204 | A * | 4/1989 | Batty | 439/681 |
| 5,643,009 | A * | 7/1997 | Dinkel et al. | 439/595 |
| 5,766,020 | A * | 6/1998 | Hughes | 439/35 |
| 6,309,258 | B1 * | 10/2001 | Measley | 439/738 |
| 6,482,028 | B2 * | 11/2002 | Kumamoto et al. | 439/498 |
| 2001/0031582 | A1 * | 10/2001 | Ushio et al. | 439/680 |
| 2002/0070702 | A1 * | 6/2002 | Ragnarsson | 320/101 |

* cited by examiner

*Primary Examiner*—Hae Moon Hyeon
*Assistant Examiner*—Harshad C Patel
(74) *Attorney, Agent, or Firm*—Hayes Soloway P.C.

(57) ABSTRACT

In order to connect an electric PE (protective earth) contact with an electrically conductive connector housing, PE (protective earth) contact that is realized in the form of a pin or socket contact and arranged in a sleeve of an insulating supply insert that is directly contacted with the connector housing and fixed by means of a screw connection.

6 Claims, 3 Drawing Sheets

ELECTRIC CONTACT FOR CONTACTING A PROTECTING CONDUCTOR WITH CONDUCTIVE HOUSING

BACKGROUND OF THE INVENTION

1. Field of the Invention

The invention pertains to an electric contact in an insulating housing that features several sleeves and is connected to an electrically conductive housing by means of a screw connection.

An electric contact of this type is required for contacting a PE (protective earth) conductor or protective cover with an electrically conductive metal housing.

2. Description of the Related Art

Electric contacts to be inserted into insulating connector inserts of a plug-type connector typically feature a mating region and a connecting region that is realized in the form of a screw connection, soldering connection or crimping connection.

However, such contacts cannot be used if a so-called PE (protective earth) contact is required as a protective measure against dangerous shock currents, e.g., when working with a 230 V operating voltage, wherein this contact produces an electric connection with a grounded point of a power source.

SUMMARY OF THE INVENTION

The invention is based on the objective of realizing an electric contact of the initially cited type in such a way that it not only features a mating region and a crimping region for being connected to an electric conductor, but can also be securely connected to a surrounding electrically conductive housing.

This objective is obtained in that the electric contact in the form of a pin or socket features a mating region and a connecting region, wherein the mating region and the connecting region are separated from one another by a thickened region. The advantages attained with the invention can be seen, in particular, in that a direct electric contact with a metallic housing is produced with the inventive electric contact, to which a so-called PE (protective earth) cable is crimped.

A PE (protective earth) cable of this type is required for producing an electric connection with a grounded point of a power source as a protective measure against dangerous shock currents.

In this case, a conventional pin or socket contact featuring a crimping connection is provided with an additional thickened region, in which a threaded bore is arranged.

This contact is positioned in an electrically insulating supply insert that comprises several sleeves together with other contacts, wherein said supply insert is advantageously arranged in a metallic connector housing together with a plug-type data module.

In this case, the supply insert is provided for the power/voltage supply and and the data module is provided for the transmission of signal voltages. It is advantageous that the electric contact makes it possible to produce a direct contact between the thickened region and an elevation in the housing interior of the connector housing that surrounds the opening for the screw connection, namely by means of its threaded bore and a screw connection, wherein the electric contact extends through the respective connector housing.

It is also advantageous that the supply insert is provided with locking means that make it possible to produce a simple connection with a data module to be accommodated in the connector housing.

At least one of the interconnectable sleeve pairs is provided with corresponding polarization means in order to prevent a mismatched connection between both supply inserts.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
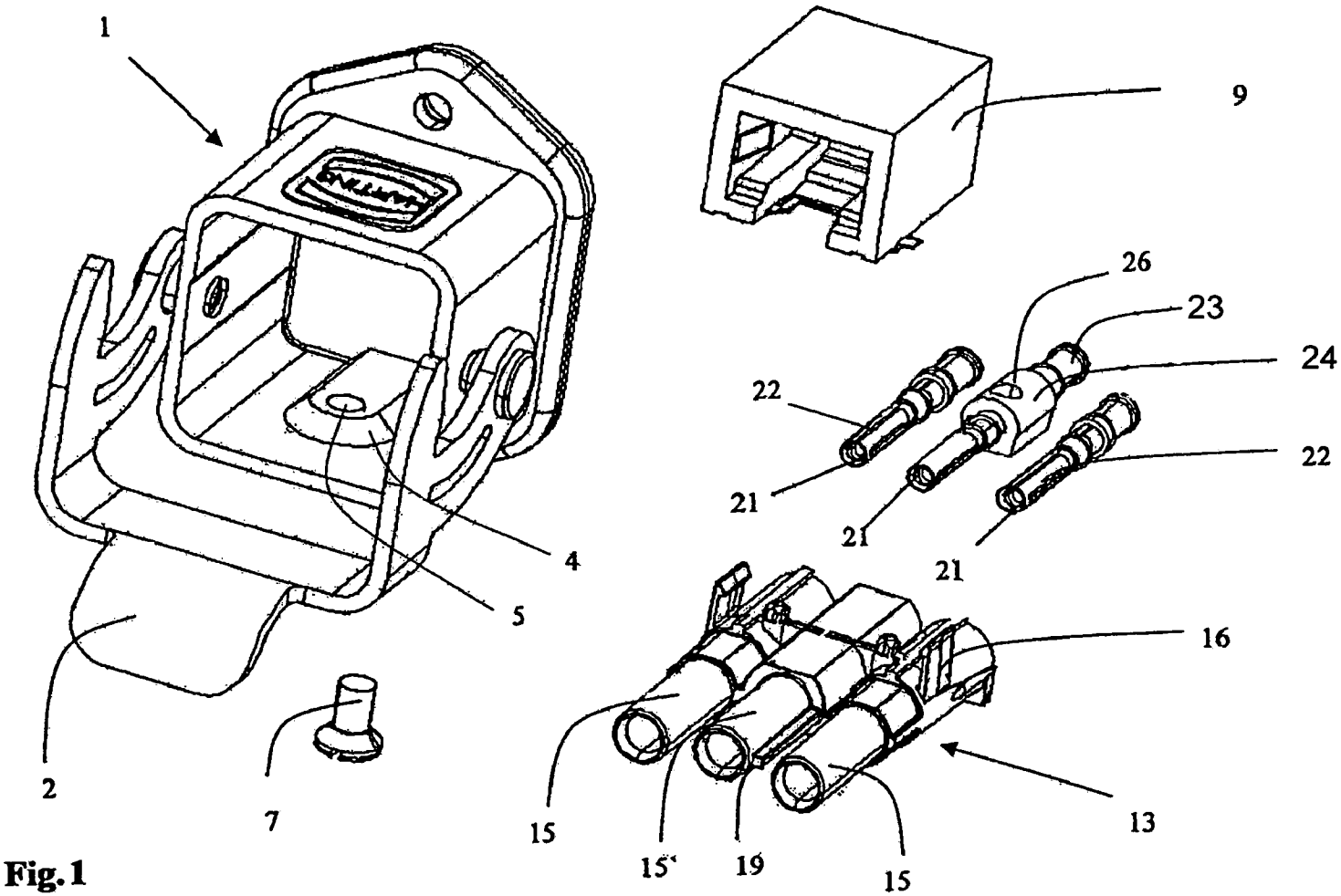
FIG. 1, is a connector housing that is provided with a flange and features two plug-type connector modules, wherein an inventive electric contact is arranged in one of the modules.

FIG. 1 shows the connector housing 1 that is provided with a screw-on flange and into which a connector set can be inserted that is composed of a so-called RJ-45 data module 9 in the form of a socket and a supply insert 13.

A locking clip 2 is also provided for fixing a mating connector 3.

The supply insert 13 is composed of an electrically insulating housing that consists of three adjacently arranged and interconnected sleeves 15, 15', into which an electric contact 21, 21' in the form of a socket contact can be respectively inserted. The contacts are conventionally fixed within the sleeves by means of (not-shown) check cones.

In this case, the central electric contact 21' that is referred to as the FE (protective earth) contact has a peculiar feature, namely a thickened region 24 that is arranged between the mating region 22 and the crimping region 23.

The thickened region 24 contains a bore 26 that is provided with a thread.

The thickened region may have any conceivable shape that ensures, for example, an unmistakable or polarizing arranagement of the contact within the sleeve.

The central sleeve 15' accommodating the FE (protective earth) contact furthermore contains an opening 17 that corresponds to the thickened region 24.

The supply insert 13 features two locking arms 16 that are respectively arranged on the outer sleeves 15, wherein the RJ-45 data module 9 can be inserted and locked in said arms.

After the assembly of the two different connector units, they need to be inserted into the connector housing 1.

The two connector units are fixed by means of a screw 7 that is screwed into the threaded bore 26 of the thickened region 24 on the central contact 21' from outside the connector housing 1, namely through an opening 5 provided therein.

Since the central contact accommodates a so-called PE (protective earth) conductor, a reliable direct electric contact is ensured by the surfaces between the PE (protective earth) contact 21' and the metallic connector housing 1 in which a correspondingly designed elevated shoulder 4 is provided. and the metallic connector housing 1 in which a correspondingly designed elevated shoulder 4 is provided.

Figure 2:
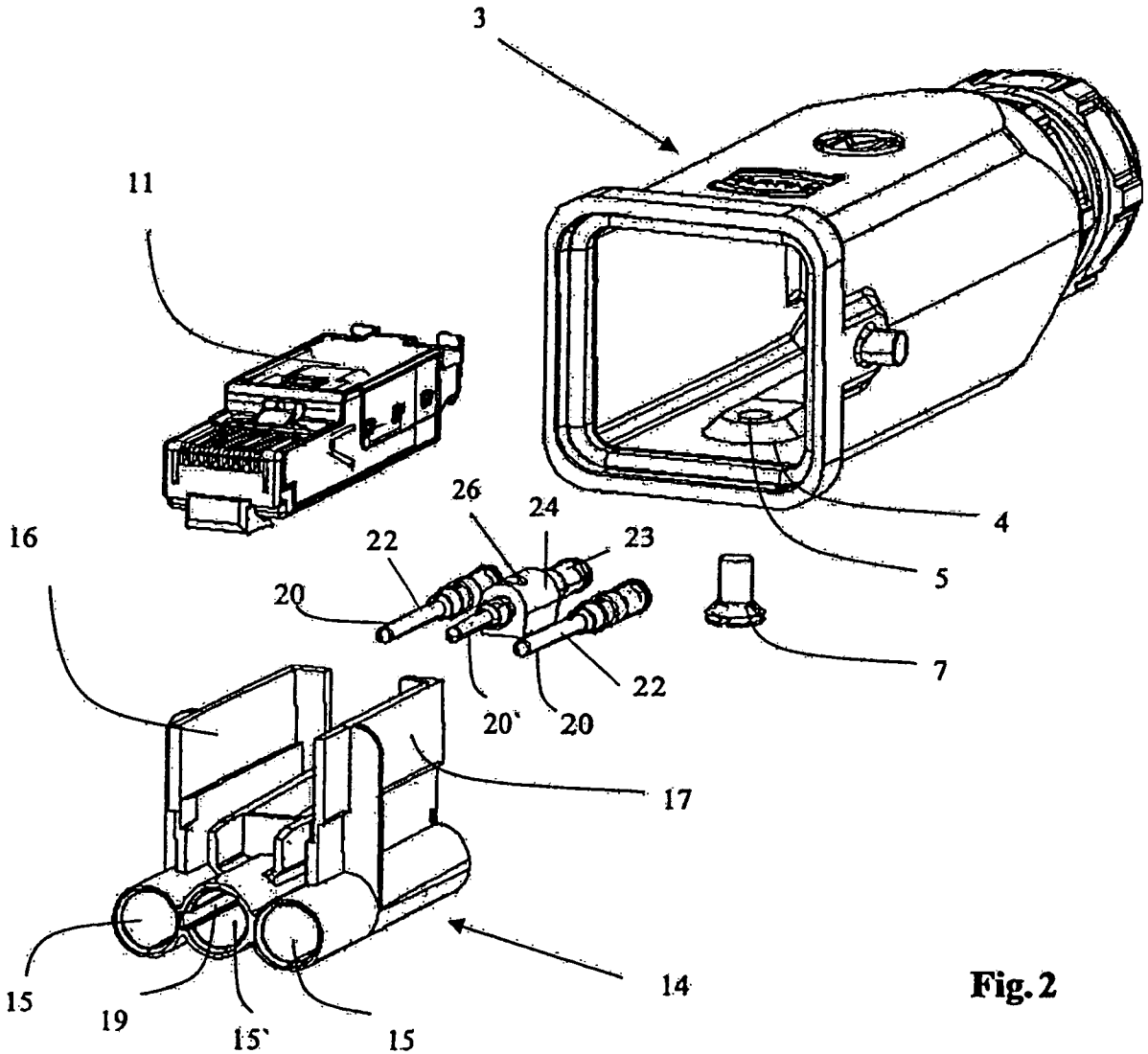
FIG. 2 is a connector housing with two plug-type connector modules, wherein the inventive electric contact is arranged in one of the modules.

FIG. 2 shows a mating connector that corresponds to the flanged connector housing 1 according to FIG. 1 and features a connector housing 3 for accommodating the R J-45 data module 11 realized in the form of a plug as well as the supply insert 14.

Electric contacts 20, 20' in the form of pins are inserted into the sleeves 15, to 15' in this supply insert, wherein the specially designed central contact 20' is positioned in the central sleeve 15'.

In order to accommodate the R J-45 data module 11, locking arms 16 are integrally moulded onto the outer sleeves 15' in accordance with the shape of the data module.

The central contact 20' of these pin contacts not only features a mating region 22 and a connection region realized in the form of a crimping connection 23, but also a thickened region 24 in which a threaded bore 26 is provided for fixing the supply insert 14 in the connector housing 3.

During the assembly, the data module 11 is engaged with the supply insert 14 and the interconnected unit is inserted into the connector housing 3 and fixed therein by means of the screw 7, wherein an electrically conductive contact between the pin contact 20' and the connector housing 3 is simultaneously ensured.

Furthermore, a polarization element is molded lateral outside the central sleeve 15' of the supply insert 13, in the form of a polarization groove 19 inside of the supply insert 14.

Figure 3B:
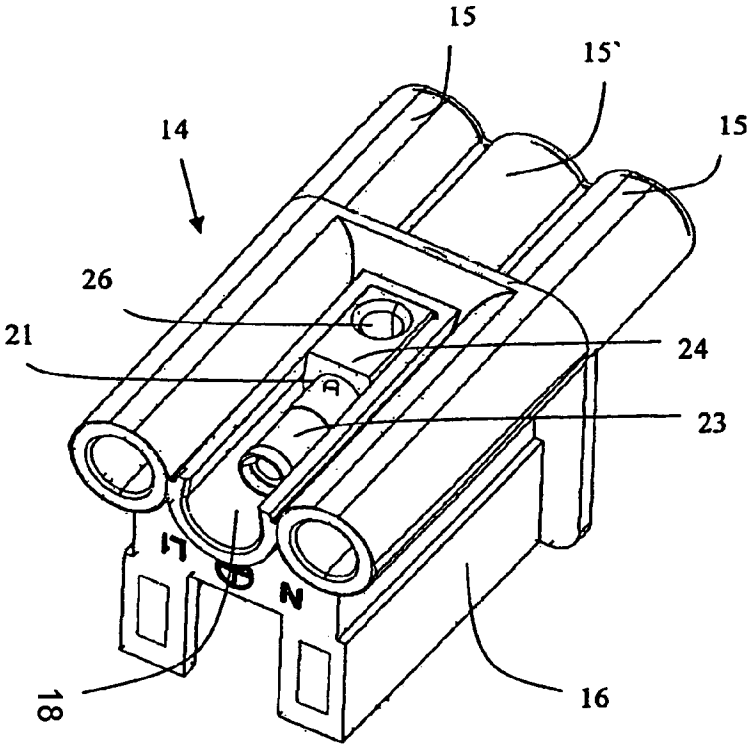
FIG. 3*a*, a view to one of the supply insert modules, and FIG. 3*b*, a view to the other supply insert modules.
Figure 3A:
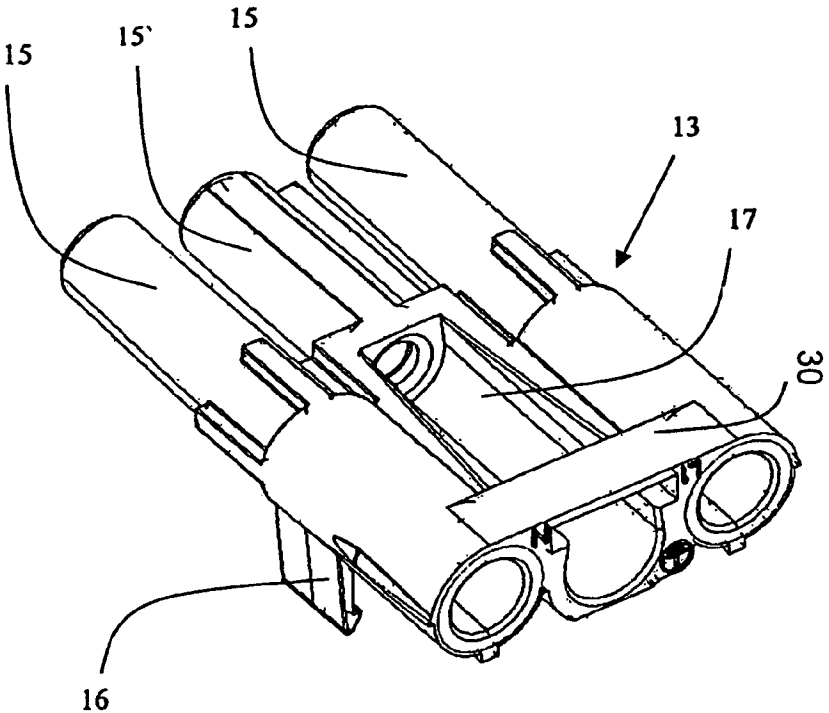

FIG. 3*a* shows a supply insert 13 with sleeves 15, 15' that are arranged in a row and serve for inserting socket contacts 21, 21'.

The oblong opening 17 in the central sleeve 15' is covered with a web 30 on its open end, wherein the socket contact 21' to be fitted therein is inserted underneath said web.

FIG. 3*b* shows the supply insert 14 with a view of the opening 18 in the central sleeve 15', into which a socket contact 21' is inserted with its mating side as far as the stop of the thickened region 24. Due to a recessed arrangement of the pin or socket contacts 20', 21' in the sleeves 15', an elevated shoulder 4 is realized on the connector housings 1, 3 such that a direct contact is ensured between the thickenings 24 of the pin or socket contacts and the connector housings 1, 3.

What is claimed is:

1. An electrical connector assembly comprising:

a conductive connector housing including an opening;

an insulating supply insert that features several sleeves side by side; and plurality of electric contacts, each of which are formed as a pin or socket contact for inserting within the sleeves of the insulating supply insert, wherein the electric contact comprises a mating region and a connection region, the mating region and the connection region of one of the electric contacts are separated from one another by a thickened region, a bore featuring a thread for a conductive screw is provided in the thickened region perpendicular to the centerline of the electric contact with the thickened region and aligned with the opening, the insulating supply insert with the electric contacts is inserted within the conductive connector housing.

2. The electrical connector assembly according to claim 1, wherein the electric contact with the thickened region is inserted in the middle sleeve of the insulated supply insert, and wherein the insulated supply insert is fixed in the conductive connector housing via the conductive screw.

3. The electrical connector assembly according to claim 1, wherein the insulated supply insert includes an oblong opening for a direct contact of the thickened region with an elevated shoulder within the conductive connector housing.

4. The electrical connector assembly according to claim 1, wherein the middle sleeve of the insulating supply insert features an interlocking polarization element.

5. The electrical connector assembly according to claim 1, wherein the insulating supply insert includes integrally molded locking arms.

6. The electrical connector assembly according to claim 1, wherein the insulated supply insert features a web.

* * * * *